US005084145A

United States Patent [19]

Suzuki et al.

[11] Patent Number: 5,084,145

[45] Date of Patent: Jan. 28, 1992

[54] METHOD FOR MANUFACTURING ONE-SIDED ELECTROPLATED STEEL SHEET

[75] Inventors: Nobukazu Suzuki; Seiji Bando, both of Ibaraki; Hirofumi Kurayasu, Sanda; Kazunobu Okawa, Ibaraki, all of Japan

[73] Assignee: Sumitomo Metal Industries, Ltd., Osaka, Japan

[21] Appl. No.: 514,938

[22] Filed: Apr. 26, 1990

[30] Foreign Application Priority Data

| | | | |
|---|---|---|---|
| Apr. 27, 1989 | [JP] | Japan | 1-108455 |
| Oct. 18, 1989 | [JP] | Japan | 1-271196 |
| Jan. 9, 1990 | [JP] | Japan | 2-2326 |
| Feb. 22, 1990 | [JP] | Japan | 2-42169 |

[51] Int. Cl.[5] ..... C25D 7/06

[52] U.S. Cl. ..... 205/141; 205/206; 205/217; 205/244; 205/245; 205/311; 205/312

[58] Field of Search ..... 204/28, 34

[56] References Cited

FOREIGN PATENT DOCUMENTS 172592 7/1989 Japan .

298192 12/1989 Japan .

OTHER PUBLICATIONS

Chemical Abstracts, vol. 98, No. 18, May 1983, p. 523, Abstract No. 151793k.

Patent Abstracts of Japan, vol. 6, No. 235 (C-136) [1113], Nov. 20, 1982.

*Primary Examiner*—T. M. Tufariello

*Attorney, Agent, or Firm*—Burns, Doane, Swecker & Mathis

[57] ABSTRACT

In a method for manufacturing a one-sided electroplated steel sheet by electroplating of a steel sheet in an acidic bath, an adsorption film-forming organic inhibitor is added to either (a) the electroplating solution or (b) a pickling solution used prior to electroplating and/or rinse water used for rinsing the pickled sheet in a concentration of at least 1 ppm, or it is added to (c) both the plating solution and the pickling solution and/or rinse water in a concentration of at least 0.1 ppm. The steel sheet is then passed through the inhibitor-containing solution, thereby providing a one-sided electroplated steel sheet having improved appearance and adaptability to phosphating on the unplated side.

20 Claims, 1 Drawing Sheet

Fig. 1
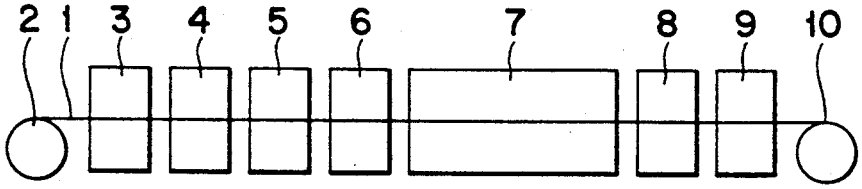
Fig. 2
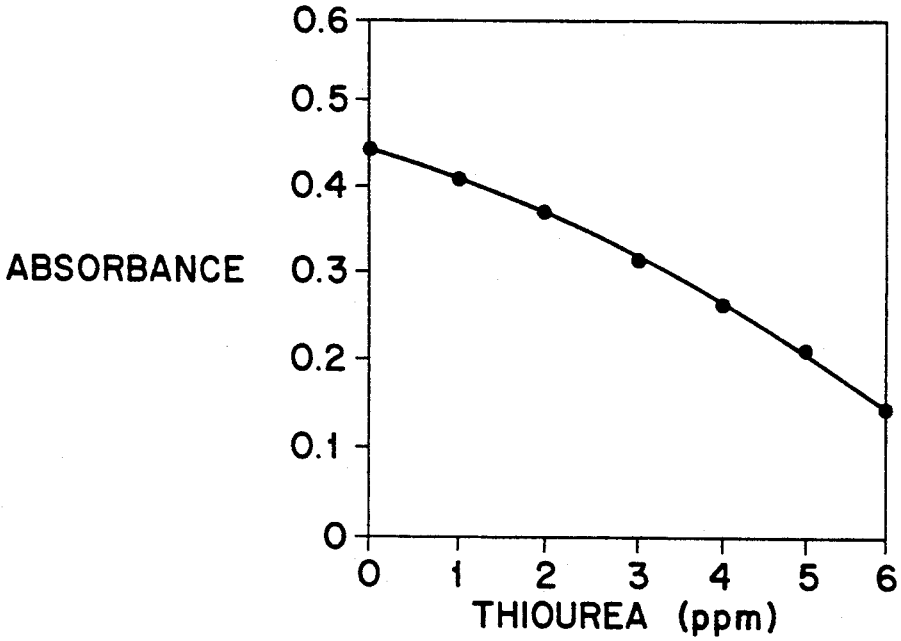
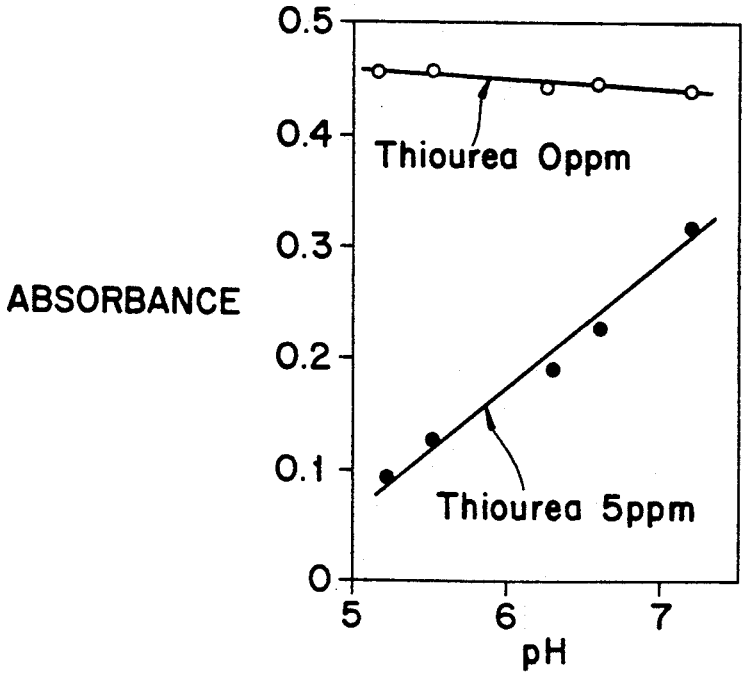
Fig. 3

METHOD FOR MANUFACTURING ONE-SIDED ELECTROPLATED STEEL SHEET

BACKGROUND OF THE INVENTION

1. Field of the Invention

This invention relates to a method for manufacturing a steel sheet which is electroplated on only one side thereof, hereafter referred to as a one-sided electroplated steel sheet. More particularly, it relates to a manufacturing method for one sided electroplated steel sheet having a zinc-based plated coating on one side, and an unplated side having good appearance and adaptability to chemical conversion treatment. The resulting steel sheet is suitable as rust-resisting steel sheet for use in automobile manufacture.

2. Prior Art

Recently, one-sided electroplated steel sheets which are usually coated with a corrosion-resistant zinc-based electroplating on one side have been used extensively as rust-preventing steel sheet in the manufacture of automobile bodies in order to improve the durability of automobiles. The other side of such a one-sided electroplated steel sheet which is not coated with plating will be referred to as the unplated side.

The term "zinc-based plating" used herein encompasses both pure zinc plating and zinc alloy plating. Of the zinc-based one-sided plated steel sheets, the proportion of those plated with a zinc alloy such as Zn—Ni is increasing since they have excellent corrosion resistance.

An automobile body can be made from a one-sided plated steel sheet with the plated side facing the inner surface of the body. In this case, the inner surface of the body which is not coated with paint has good corrosion resistance due to the zinc-based plating. Since the outer, painted surface of the body is formed from the unplated side of the steel sheet, it exhibits good weldability and adhesion to paint, properties inherent to unplated surfaces of steel sheets.

One-sided electroplated steel sheets are manufactured by passing a steel sheet through a plating bath while passing a current between the steel sheet which serves as a cathode and an anode on either side of the steel sheet. This manufacturing method involves the following problem.

In the continuous manufacture of a zinc-based one-sided plated steel sheet, an acidic plating solution such as a sulfate solution or a chloride solution is employed. The acidic plating solution attacks and corrodes the unplated side of the steel sheet, thereby forming black smudges caused by deposition of corrosion products. This phenomemon is called acid burning and it deteriorates not only the appearance of the unplated side by the discoloration, but also the adaptability to chemical conversion treatment such as phosphating which must be performed prior to painting to improve the adhesion of a paint. As a result, the adhesion of paint to such an acid-burned surface is deteriorated.

Therefore, in actual plating operation, mechanical or electrolytic polishing is performed on the unplated side of the one-sided plated steel sheet in order to remove the metallic or other smudges deposited on the unplated side.

Mechanical polishing, which is performed by brushing or other abrasive means can remove the black smudges on the unplated side to a certain degree, but it is accompanied by abrasion of the underlying steel plate. This leads to a decrease in the surface roughness of the unplated side, which may cause slip to occur in the blanking line when the plated steel sheet is blanked out during automobile manufacture.

For this reason, the black smudges formed on the unplated side are usually removed by electrolytical treatment after one-sided electroplating. The following methods have been proposed for carrying out the post-plating electrolytic cleaning of the unplated side.

(a) Electrolysis is performed in a solution containing 50–300 g/l of a mixture of a sulfate and a phosphate at a pH of 5–9 [Japanese Unexamined Patent Application Publication No. 62-99494(1987)];

(b) Electrolysis is performed in a bath containing a sulfur compound by a combination of anodic treatment and cathodic treatment [Japanese Unexamined Patent Application Publication No. 62-13595(1987)];

(c) After thin plating, electrolysis is performed in a bath containing a pH buffer and an oxidizing agent by passing a current indirectly between the unplated side, which serves as an anode, and the plated side, which serves as a cathode [Japanese Unexamined Patent Application Publication No. 61-163292(1986)];

(d) Electrolysis is performed in an aqueous solution of a water-soluble sulfate which contains triethanolamine [Japanese Unexamined Patent Application Publication No. 61-117300(1986)];

(e) Electrolysis is performed in an aqueous solution containing a sulphate or a phosphate by anodic treatment [Japanese Unexamined Patent Application Publication No. 61-106800(1986)];

(f) Electrolysis is performed in a conductive bath at pH 4–10 containing 0.05–2.0% of a surfactant by anodic treatment [Japanese Patent Publication No. 61-36597(1986)];

(g) Electrolysis is performed in a solution containing a particular kind of sulfur compound by anodic treatment or cathodic treatment [Japanese Patent Publication No. 61-41990(1986)];

U.S. Pat. No. 4,464,232 also discloses post-plating electrolytic polishing of a one-sided electroplated steel sheet.

These methods of post-plating electrolysis require several electrolytic cells in order to achieve a satisfactory cleaning effect. However, due to space and cost restrictions, only one or two electrolytic cells are usually employed and it is difficult to sufficiently clean the unplated side in the short period of several seconds during which the steel sheet is passed through the cells. Particularly in the manufacture of a one-sided plated steel sheet with a zinc alloy (such as Zn—Ni alloy) coating, the alloying element such as Ni which is nobler than Fe is inevitably deposited on the unplated side during electroplating. It is more difficult to remove such nobler alloying elements deposited on the unplated side by post-plating electrolysis carried out for only a short period.

SUMMARY OF THE INVENTION

Accordingly, it is an object of the present invention to provide a method for manufacturing a one-sided electroplated steel sheet which does not have the above-mentioned problems.

It is another object of the invention to provide a method of steadily manufacturing a one-sided electroplated steel sheet having improved appearance and adaptability to chemical conversion on the unplated side.

The present invention is based on the following discoveries.

(a) In view of space and cost restrictions, post-plating electrolysis or mechanical polishing of the unplated side to remove black smudges formed thereon are not viable cleaning methods. It is necessary to prevent the acid burning of the unplated side from occuring in the first place due to attack by the acidic plating solution.

(b) Addition of a suitable amount of an adsorption film-forming organic inhibitor to the plating solution is quite effective for preventing acid burning and keeps the unplated side clean during electroplating without adversely affecting the adaptability to chemical conversion. It is believed that the organic inhibitor is adsorbed by active sites on the surface of the steel sheet, thereby preventing the unplated side from being attacked by the acidic plating solution.

(c) An adsorption film-forming organic inhibitor is also effective for preventing acid burning when added to either a pickling solution used prior to plating or the rinse water used for rinsing the pickled sheet or both. When so employed, it is believed that the inhibitor is also adsorbed by active sites on the surface of the steel sheet and the adsorbed inhibitor effectively prevents acid burning of the unplated side during the subsequent plating.

The present invention is a method for manufacturing a one-sided electroplated steel sheet by electroplating of a steel sheet in an acidic bath, comprising adding an adsorption film-forming organic inhibitor to (a) an electroplating solution in a concentration of at least 1 ppm, or (b) at least one of a pickling solution used prior to electroplating and rinse water used for washing the pickled sheet in a concentration of at least 1 ppm, or (c) both the plating solution and at least one of the pickling solution and rinse water in a concentration of at least 0.1 ppm, and passing the steel sheet through the inhibitor-containing solution.

The pickling solution and rinse water used before electroplating are hereinafter referred to as the pre-plating pickling solution and rinse water, respectively.

In a preferred embodiment, the concentration of the organic inhibitor in the solution is maintained in a predetermined range by determining the concentration of the solution in the circulation line through which it is circulated and adding, if necessary, the inhibitor to the solution in an amount sufficient to maintain the concentration in the predetermined range.

In another preferred embodiment, the unplated side of the resulting one-sided plated steel sheet is lightly ground with an abrasive brush.

According to the method of the present invention, a one-sided plated steel sheet having good appearance and adaptability to chemical conversion treatment on the unplated side can be manufactured without significant adverse effect on the properties of the plated side and with no need of subjecting the unplated side to post-plating electrolysis.

BRIEF DESCRIPTION OF THE DRAWINGS

FIG. 1 schematically illustrates a typical arrangement of cells in an electroplating apparatus for steel sheet;

FIG. 2 is a calibration curve for the quantitative analysis of thiourea with a sodium azide-iodo-starch reagent; and FIG. 3 is a graph showing the relationship between absorbance and pH in the above quantitative analysis.

DETAILED DESCRIPTION OF THE INVENTION

The method according to the present invention can be used for the manufacture of any zinc-based electroplated steel sheet having a plated coating of pure zinc or a zinc alloy on one side. The coating is preferably a zinc alloy coating such as a Zn—Ni, Zn—Fe, Zn—Co, Zn—Ni—Co, or Zn—Mn coating. The present method is also used for one-sided plating with other metals or alloys in an acidic plating bath.

FIG. 1 schematically shows a typical arrangement of cells in an electroplating apparatus for steel sheet. A steel sheet or strip 1 (hereafter referred to as a steel sheet) which is fed from an uncoiler 2 is continuously passed through a degreasing cell 3, a washing cell 4, a pickling cell 5, and a washing cell 6 to clean the surface to be plated. The sheet is then plated on one side in an electroplating cell 7, and the resulting one-sided plated sheet is passed through a washing cell 8 and a drying chamber 9 and is rewound by a recoiler 10.

According to the method of the present invention, an adsorption film-forming organic inhibitor is added to either (a) the plating solution in the plating cell 7, or (b) the pickling solution in the pickling cell 5 located before the plating cell 7 and/or the rinse water in the washing cell 6 for washing the pickled sheet, or to both (a) and (b) in a minor amount sufficient to suppress acid burning of the unplated surface during electroplating.

If a one-sided electroplated steel sheet is treated by the above-mentioned conventional post-plating electrolysis to remove the deposits on the unplated surface, it is necessary to install one or more additional electrolytic cells and at least one washing cell between the washing cell 8 and the drying chamber 9, thereby increasing the complexity of the plating apparatus and procedure. On the contrary, the present method is economical in that it does not need any additional electrolytic cell or washing cell.

The type of adsorption film-forming organic inhibitor used in the present invention is not critical. Representative examples of such inhibitors include various sulfur-containing and nitrogen-containing organic compounds. Since the plating solution is an acidic chloride or sulfate solution having a low pH, those organic inhibitors which have conventionally been used in pickling steel sheets may be used in the present invention. These organic inhibitors, however, have not been added to a pickling solution to be used prior to electroplating since they have been considered to adversely affect plating operation.

Inhibition of corrosion by adding a small amount of a special substance (corrosion inhibitor) to a corrosive environment has been generally carried out for many years as a corrosion protection technique for metals. Numerous inhibitors useful for this purpose are known in the art. They can be classified in various manners as follows:

Classification by type of compound

Inorganic inhibitors: chromates, nitrites, etc.

Organic inhibitors: amines, amides, acetylene, mercaptans, etc.

Classification by functional mechanism

Anodic inhibitors: phosphates, silicates, chromates, etc.

Cathodic inhibitors: magnesium salts, zinc salts, etc.
Adsorption-type inhibitors: amines, amides, acetylene, mercaptans, etc.

Of the above inhibitors, the adsorption-type organic inhibitors which are more specifically called adsorption film-forming-organic inhibitors are used in the present invention.

Such organic inhibitors are generally polar organic compounds. They are said to exert their corrosion-inhibiting effect by being adsorbed at active sites on the surface of a metal. More specifically, they have mobile electrons such as a lone pair of electrons in an N, S, or O atom or $\pi$ electrons in an unsaturated bond. These electrons move toward the metal surface and are adsorbed thereby. Such adsorption occurs either in the anodic or cathodic region or both, whereby the corrosive reaction in that region or regions is retarded or decelerated.

In the present method, one or more of such organic inhibitors is added either to an electroplating solution or a pickling solution and/or rinse water used before the electroplating, or to both of them. It is believed that the organic inhibitor is adsorbed by the surface of the steel sheet to form an adsorption film, which prevents $H^+$ ions from discharging, thereby inhibiting dissolution of iron ions into the plating solution. As a result, the formation of black smudges on the surface of the unplated side is prevented and deterioration in appearance and adaptability to chemical conversion can be avoided.

The organic compounds which serve as an inhibitor have one or more polar groups in each molecule which are readily adsorbed by a metal surface. The polar groups have mobile electrons in the form of either a lone pair of electrons in an N, S, or O atom or $\pi$ electrons in an unsaturated bond. The adsorptivity of the inhibitor and the strength of adsorption bond depend on the size and configuration of the inhibitor molecule as well as its tendency toward orientation and electric charge. In addition, ions present in the electroplating solution participate in the formation of the adsorption film and the electrical double layers on or near the steel surface and hence influence the structure thereof. Thus, the behavior of an inhibitor in hydrochloric acid is usually different from that of the same inhibitor in sulfuric acid.

For example, when a sulfate electrolytic bath is used, it is preferable to use an organic inhibitor having an S atom which exhibits a particularly high adsorptivity in a sulfate solution, although those inhibitors having an N or O atom may be used. When a chloride bath is used, an inhibitor having an N atom is preferred, although other inhibitors may be used.

Some specific examples of inhibitors having an S atom with a lone pair of electrons and those having an N atom with a lone pair of electrons are shown in Tables 1 and 2, respectively, although other S- or N-containing organic inhibitors are useful. In Tables 1 and 2, R, R', and R'' each stand for a hydrocarbon group, while A and A' each stand for an amino group. Each of these groups may be aliphatic, alicyclic, or aromatic.

TABLE 2

| Nitrogen-containing inhibitors | |
|---|---|
| Structure | Class name |
| $RNH_2$ | Primary amines |
| $R_2NH$ | Secondary amines |
| $RN(CH_3)_2$ | Tertiary amines |
| $RNH(CH_2)_3NH_2$ | Diamines |
| 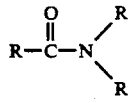 | Amides |
| 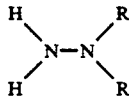 | Hydrazines |
| 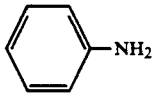 | Aniline (Aromatic amines) |
| 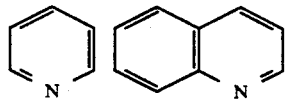 | Left: Pyridine Right: Quinoline (Heterocyclic amines) |
| 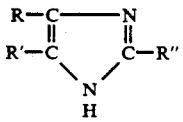 | Imidazoles |
| 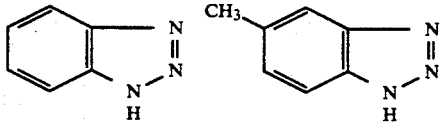 | Triazoles |

TABLE 1

| Sulfur-containing inhibitors | |
|---|---|
| Structure | Class name |
| R—SH | Mercaptans |
| R—SCN | Thiocyanates |
| R—S—R' | Sulfides |
| R—SS—R' | Disulfides |
| 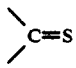 | Thiocarbonyl-containing compounds |
| e.g., 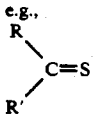 | Thiocarbonyl compounds |
| 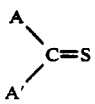 | Thioureas |
| 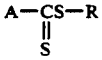 | Dithiocarbamates |

TABLE 1-continued

| Sulfur-containing inhibitors | |
|---|---|
| Structure | Class name |
| 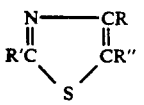 | Thiazoles |

Organic inhibitors having an O atom with a lone pair of electrons include aldehydes such as formaldehyde and acetaldehyde, and ketones such as acetone. Those having $\pi$ electrons include alkynes such as acetylene.

The particular organic inhibitor and the amount thereof which is added may be selected in accordance with the type of plating solution, plating conditions, and the type of solution (including rinse water) to which the inhibitor is added.

When the organic inhibitor is added to either an electroplating solution or at least one of a pre-plating pickling solution and rinse water, addition of an organic inhibitor to the solution in a concentration of about 1 ppm or more is generally effective for the protection of the unplated side of the steel sheet from acid burning due to chemical attack by the plating solution during electroplating.

The adsorptivity of the organic inhibitor by a steel surface also depends on the pH of the solution to which it is added. As the pH of the solution decreases, the inhibitor tends to be adsorbed more readily so that the concentration thereof in the solution required to prevent acid burning can be decreased. However, if the concentration of the inhibitor is less than about 1 ppm, acid burning may not be prevented sufficiently.

The maximum concentration of the inhibitor is not limited to a particular value. However, the presence of an inhibitor in an excessively high concentration may cause a change in the composition or phase structure of the plated coating, particularly in the case of zinc alloy plating. Therefore, it is generally preferred that the inhibitor concentration be not higher than 100 ppm and more preferably not higher than 50 ppm. In most cases, addition of an inhibitor in an amount of 1-10 ppm is sufficient to provide generally satisfactory results.

However, when the organic inhibitor is added to an electroplating solution, particularly of a sulfate bath which generally has a low pH, it is desirable that the maximum concentration of the inhibitor be controlled so as not to exceed 10 ppm and preferably 5 ppm. Thus, the concentration of the inhibitor in the electroplating solution is preferably in the range of 1-10 ppm and more preferably in the range of 1-5 ppm. A higher concentration of the inhibitor may change the orientation of the grains in a pure zinc electroplated coating, leading to tarnishing of the coating and resulting in a grayish black appearance. A higher concentration may also change the alloy composition of a zinc alloy electroplated coating such as a Zn—Ni or Zn—Fe coating. For example, it may decrease the Fe or Ni content, thereby decreasing the corrosion resistance of the electroplated steel sheet in some instances.

When the electroplating solution is a chloride bath which generally has a pH higher than a sulfate bath, a higher inhibitor concentration, for example, 7-50 ppm is suitable.

Addition of the organic inhibitor in a preceding stage, i.e., to a pre-plating pickling solution and/or rinse water, is advantageous in that the above-mentioned problems are eliminated and the inhibitor concentration in the solution may be as high as 100 ppm. Although an inhibitor concentration as low as 1 ppm is effective to an appreciable degree, it is preferable to add the inhibitor so as to give a concentration of at least 5 ppm. When added in a preceding stage, the concentration of the inhibitor is preferably in the range of 5-50 ppm and more preferably in the range of 5-10 ppm.

Thus, when a steel sheet is treated with an organic inhibitor-containing pickling solution or rinse water prior to electroplating by immersing the sheet, the surface of the steel sheet adsorbs the inhibitor and the adsorbed inhibitor effectively protects the unplated side of the steel sheet from chemical attack by the acidic electroplating solution and acid burning in the subsequent plating step.

The pretreatment of the steel sheet with the inhibitor-containing solution (pre-plating pickling solution or rinse water) may be performed under the same conditions as employed in ordinary pickling or washing procedure. Namely, the steel sheet can be immersed in the solution at ambient temperature, e.g., about 25° C., for 1-10 seconds, e.g., about 5 seconds.

The organic inhibitor may be added to either one or both of the pre-plating pickling solution and the rinse water.

Alternatively, the organic inhibitor may be added to both the electroplating solution and the pre-plating pickling solution or rinse water. Due to a synergistic effect in this case, a much lower concentration of the inhibitor (as low as 0.1 ppm) is effective for both solutions. The inhibitor concentration is preferably in the range of 0.1-5 ppm for both solutions, and particularly for the electroplating solution of a sulfate bath it is more preferably in the range of 0.1-1 ppm.

When the inhibitor concentration is this low, there is no substantial adverse effect on the electroplated coating by addition of an organic inhibitor to the electroplating solution, which is an important advantage. The inhibitors added to the electroplating solution may be the same or different from that added to the pre-plating pickling solution or rinse water.

The organic inhibitor added to the electroplating solution and/or pre-plating pickling solution or rinse water in a small amount according to the present invention is gradually consumed due to entrainment by the steel sheet or decomposition, and the concentration thereof in the solution will gradually decrease.

In a preferred embodiment, the concentration of the organic inhibitor in the solution is maintained in a predetermined range by determining the concentration of the solution in the circulation line through which it is circulated and adding, if necessary, the inhibitor to the solution in an amount sufficient to maintain the concentration in a predetermined range.

In a continuous electroplating operation, each of the treating solutions such as an electroplating solution and a pickling solution is used while a portion thereof is continuously withdrawn from the cell. After adjustment of the composition of the withdrawn solution, a major portion thereof is returned to the cell through a circulation line. Thus, the concentration of the inhibitor in the solution may also be adjusted in the circulation line of the solution.

More specifically, a sample is withdrawn from the solution passing through a circulation line to determine the concentration of the organic inhibitor. Any suitable method for quantitative analysis of the inhibitor may be employed including titration methods such as argentometry and iodometry, spectrophotometric methods such as the nitroprusside method and the sodium azide-iodo-starch method, and voltammetric methods, depending on the particular inhibitor.

On the basis of the concentration of the inhibitor thus determined, an amount of the inhibitor sufficient to maintain the concentration in the predermined range is added, if necessary, to the solution in the circulation line, which is recycled into the cell. As a result, the concentration of the inhibitor in the solution is constantly maintained in the predetermined range, and the desired effects on plating operation of the addition of the inhibitor can be attained in a stable manner. The efficiency of plating is also improved.

In cases where the organic inhibitor is a compound having an S atom with a lone pair of electrons, a particularly preferred method for determining the concentration of the inhibitor is the sodium azide-iodo-starch method.

Quantitative analysis according to this method can be carried out preferably after the metallic ions present in the inhibitor-containing solution to be assayed are removed by adding a ferric ion-containing solution followed by an alkali to the solution so as to adjust the pH to about 10. The metallic ions are precipitated along with ferric hydroxide by the addition of an alkali and are then removed by a suitable separation means such as centrifugation. A sodium azide-iodo-starch color reagent is added to the remaining solution and the absorbance of the solution is determined.

A solution containing a mixture of iodine ($I_2$) and starch turns blue. When sodium azide is added to the solution, iodine reacts with sodium azide as shown by the following equation (I) and the blue color is gradually lost.

$$2\ NaN_3 + I_2 \rightarrow 2\ NaI + 3\ N_2 \qquad (I)$$

If a compound containing an S atom with a lone pair of electrons such as thiourea is present in the solution, it serves as a catalyst to promote the above reaction and the color of the solution is lost relatively rapidly. Thus, the absorbance of the solution decreases as the concentration of the S-containing inhibitor therein increases so that there is a certain correlation between the absorbance of the solution and the concentration of the inhibitor therein.

For example, FIG. 2 shows the effect of the concentration of thiourea on the absorbance. The curve shown in this FIGURE can be used as a calibration curve to determine the concentration of thiourea in a test solution. The measurement of absorbance is performed at a wavelength equal to or near the maximum absorption of the test solution, such as at 585 nm in the measurements shown in FIG. 2.

As stated above, the metallic ions present in the inhibitor-containing solution are preferably removed before a sodium azide-iodo-starch reagent is added to determine the concentration of the inhibitor. This is because the presence of metallic ions in an amount of several tens of parts per million or more in the solution may interfere with the color development of the reagent. Therefore, when the solution to be assayed is an electroplating solution, such removal of metallic ions is essential since the solution usually contains metallic ions in a total concentration as high as 10% or more. However, if a pre-plating pickling solution or rinse water is assayed and it contains metallic ions in a concentration of less than 10 ppm, the sodium azide-iodo-starch reagent can be added to the solution without removal of the metallic ions.

As shown in FIG. 3, the absorbance of a test solution in the sodium azide-iodo-starch method varies with the pH of the solution. Therefore, it is necessary to maintain a constant pH both during the measurement to prepare a calibration curve and during the measurement of test solutions.

When the metallic ions are removed from the solution to be assayed by precipitation of ferric hydroxide in the above-mentioned manner, the solution has a pH of approximately 10 and it is necessary to control the pH of the solution in a narrow range. However, it has been found that, if a phthalate buffer (pH 4) is added to the sodium azide-iodo-starch reagent, it is possible to extend the range by which the pH can be adjusted when the reagent is reacted with the test solution. Thus, in the presence of a phthalate buffer, the absorbance of a test solution does not appreciably vary in the pH range of 9.5–10.5 and it is possible to determine the concentration of an S-containing compound accurately and rapidly in this pH range. Addition of a buffer to a color reagent is also advantageous in that the stability of the reagent is generally increased and the service life of the reagent is extended.

When an organic inhibitor is added to an electroplating solution for plating a zinc alloy, e.g., a Zn—Ni alloy, according to the method of the present invention, the deposition potential of the nobler metal (Ni) shifts in the noble direction due to the presence of the inhibitor. In electroplating in a vertical or horizontal electrolytic cell, turnover of electric current around the edge of the steel sheet to the back (unplated) side is prevented by masking, but turnover of a feeble current is unavoidable. Therefore, the so-called normal codeposition, i.e., preferential deposition of the nobler metal (Ni) may occur in the edge portions on the unplated side of the sheet.

As the concentration of the organic inhibitor is increased, the deposition of the nobler metal at the edges of the unplated back side becomes significant. If the nobler metal is nobler than Fe, as is the case with Ni, the metal deposited on the unplated side interferes with dissolution of the steel sheet during the subsequent phosphating treatment, resulting in the formation of bare spots or voids which are uncovered by the desired phosphate crystals.

Likewise, in the cases where the organic inhibitor is added to a pre-plating pickling solution or rinse water, the organic inhibitor adsorbed on the surface of the steel sheet is brought into the electroplating solution, and similar bare spots or voids may be observed in the phosphate film formed on the unplated side when the concentration of the inhibitor in the solution is relatively high.

In order to avoid the formation of such bare spots or voids during phosphating, if necessary, light grinding with an abrasive brush may be performed on the unplated side of the one-sided electroplated steel sheet so as to expose active sites for phosphating on the steel surface, thereby increasing susceptibility to phosphating.

As described previously, excessive grinding of the unplated side forms a cause of slip during the subsequent working of the one-sided electroplated steel sheet. Therefore, the light grinding should be performed in such a manner that the reduction in the peak count number based on the initial sheet is at most 20%. The peak count number, which is generally abbreviated as PPI, is the number per inch of raised portions having a peak height of at least 0.8 μm.

The light grinding of the unplated side is preferably performed using an abrasive brush comprised of thin wires having fine abrasive particles adhering thereto in order to minimize the reduction in surface roughness of the sheet by grinding. Examples of such brushes are model numbers 1.8S-1000-24H, 3A-1000-7H, and 3A-500-7H sold by Hotani K.K. of Japan.

When the concentration of the inhibitor is controlled in the above-mentioned manner so as to be in a certain range in which the adverse effect of the inhibitor on the plating can be avoided, e.g., to about 5 ppm or less in the cases where the inhibitor is added to the plating solution, it is possible to obtain a one-sided electroplated steel sheet exhibiting a satisfactory adaptability to phosphating on the unplated side without performing light grinding thereon.

The method according to the present invention is carried out using a conventional one-sided electroplating apparatus as schematically illustrated in FIG. 1 except that an adsorption film-forming organic inhibitor is added to either the plating solution or the pre-plating pickling solution or rinse water while controlling the concentration of the inhibitor, if necessary. Generally the plating conditions may be the same as employed in a conventional electroplating method. In the case of zinc-alloy plating, however, the composition and phase of the electroplated alloy layer may be varied by the addition of the inhibitor, so the composition of the electroplating solution should be adjusted, if necessary, so as to deposit a layer having the desired alloy composition.

The following examples are presented as illustrations of the claimed invention. It should be understood, however, that the invention is not limited to the specific details set forth in the examples.

EXAMPLE 1

A sulfate-type zinc alloy electroplating solution was prepared under the following conditions:

Composition of electroplating solution:

130 g/l of $ZnSO_4.7H_2O$ 260 g/l of $NiSO_4.6H_2O$ 75 g/l of $Na_2SO_4$ pH: 1.8

Bath temperature: 50° C.

The organic inhibitor indicated in Table 3 was added to the plating solution. Using the inhibitor-containing plating solution, a steel sheet was subjected to one-sided Zn-Ni alloy electroplating with a commercial continuous electroplating apparatus having the arrangement of cells shown in FIG. 1. The electroplating conditions were as follows:

Current density: 60 A/dm$^2$

Coating weight: 20 g/m$^2$.

The steel sheet was a 0.8 mm-thick cold rolled steel sheet. Prior to electroplating, the surface to be plated was cleaned by electrolytic degreasing in a sodium hydroxide-based electrolytic degreasing solution, washing with water, electrolytic pickling in a sulfuric acid solution, and washing with water in a conventional manner. After the electroplating, the steel sheet was washed with water and then dried to yield the desired one-sided Zn—Ni alloy electroplated steel sheet.

The unplated surface of the resulting one-sided Zn—Ni alloy electroplated steel sheet was evaluated with respect to appearance, amount of residual Ni deposited thereon, and adaptability to chemical conversion treatment.

The appearance of the unplated surface was evaluated by visual inspection of a test piece and rated as follows:

○: Good,

Δ: Slightly black-colored,

×: Black-colored,

××: Deeply black-colored.

The residual Ni amount deposited on the unplated surface was determined by fluorescent X-ray spectroscopy in the central portion of a test piece of the plated sheet.

The adaptability of the unplated surface to chemical conversion treatment was evaluated in the central portion of a test piece after it was phosphated with zinc phosphate in a conventional manner. The evaluation was performed by determining the weight of the phosphate film deposited on the unplated surface by the treatment and by observing the appearance of the phosphate film visually and on a scanning electron microscope with respect to uniformity of the film and fineness of the phosphate crystals. Also, the height of the peaks of phosphophyllite [$Zn_2Fe(PO_4)_2.4H_2O$] and hopeite [$Zn_3(PO_4)_2.4H_2O$] on an X-ray diffraction pattern of the phosphate film was measured and the P value, which is an indication of the alkali resistance and adhesion to a painted film, was calculated according to the following equation:

$$P\text{ value} = \frac{\text{peak height of phosphophyllite}}{\text{sum of peak heights of phosphophyllite and hopeite}}.$$

The Zn—Ni alloy electroplated surface of the plated sheet was also evaluated with respect to its Ni content and the phase structure of the plated coating.

The Ni content of the plated coating was determined by fluorescent X-ray spectroscopy. The phase structure thereof was identified by the X-ray diffraction method.

The test results are also included in Table 3.

As is apparent from Table 3, when an organic inhibitor was present in the electroplating solution in a concentration of at least 1 ppm, the surface on the unplated side of the resulting one-sided electroplated steel sheet did not have a black acid burning film deposited thereon and it showed improved adaptability to phosphating. However, if the inhibitor, e.g., thiourea, was present in an excessively high concentration, the Ni content of the plated alloy coating was decreased and the phase structure of the plated coating changed from the $\gamma$ phase into $\gamma+\eta$ phase.

Thus, when an inhibitor is added to the plating solution, a preferable concentration of the inhibitor in the solution is at least about 1 ppm and at most about 10 ppm, and favorable results are obtained with a concentration of as low as 5 ppm or less.

EXAMPLE 2

A chloride-type zinc alloy electroplating solution was prepared under the following conditions:

Composition of electroplating solution:

250 g/l of $ZnCl_2$ 320 g/l of KCl
100 g/l of $Nicl_2.6H_2O$
pH: 4.5
Bath temperature: 55° C.

The organic inhibitor indicated in Table 4 was added to the plating solution. Using the inhibitor-containing plating solution, a steel sheet was subjected to one-sided Zn—Ni alloy electroplating in the same manner as in Example 1 under the following conditions:
Current density: 60 $A/dm^2$
Coating weight: 20 $g/m^2$.

The unplated and plated sides of the resulting one-sided Zn—Ni alloy electroplated steel sheet were evaluated in the same manner as described in Example 1. The test results are shown in Table 4.

It can be seen from Table 4 that according to the method of the present invention, a one-sided electroplated steel sheet with the unplated side having improved appearance and adaptability to phosphating can be obtained by electroplating in a chloride bath.

EXAMPLE 3

The surface to be plated of a 0.8 mm-thick steel sheet was pretreated by electrolytic degreasing in a sodium hydroxide-based degreasing solution followed by washing with water. The surface was then subjected to electrolytic pickling in a sulfuric acid solution and washed with rinse water in which thiourea was present as an organic inhibitor in different concentrations as indicated in Table 5. The washing was performed at 25° C. for 5 seconds.

Subsequently, one-sided Zn—Ni alloy electroplating was carried out on the steel sheet under the following conditions:
Composition of electroplating solution:
120 g/l of $ZnSO_4.7H_2O$
250 g/l of $NiSO_4.6H_2O$
75 g/l of $Na_2SO_4$
pH: 2
Bath temperature: 55° C.
Current density: 60 $A/dm^2$
Coating weight: 20 $g/m^2$.

After washing and drying, the appearance, amount of residual Ni, and the adaptability to phosphating of the unplated side of the resulting one-sided Zn—Ni alloy electroplated steel sheet were evaluated in the same manner as described in Example 1. The test results are shown in Table 5.

As is apparent from Table 5, by the treatment of the steel sheet with a rinse water containing at least 1 ppm of thiourea as an organic inhibitor prior to electroplating, the acid burning on the unplated side of the resulting plated sheet could be effectively prevented thereby improving the adaptability to phosphating thereof. It is estimated that the presence of 5 ppm or more of thiourea in the rinse water would provide more favorable results.

EXAMPLE 4

The surface to be plated of a 0.8 mm-thick steel sheet was pretreated by electrolytic degreasing in a sodium hydroxide-based degreasing solution followed by washing with water. The surface was then subjected to electrolytic pickling with a current density of 20 $A/dm^2$ for 5 seconds in a 5% sulfuric acid solution at 40° C. in which mercaptan was present as an organic inhibitor in different concentrations as indicated in Table 6, followed by washing with rinse water.

Subsequently, one-sided Zn—Ni alloy electroplating was performed on the steel sheet under the same conditions as in Example 3, and the resulting plated sheet was evaluated in the same manner as in Example 3. The results are shown in Table 6.

As can be seen from Table 6, addition of an organic inhibitor to the pickling solution used before electroplating was also effective for prevention of acid burning on the unplated side.

EXAMPLE 5

The surface to be plated of a 0.8 mm-thick steel sheet was pretreated by electrolytic degreasing in a sodium hydroxide-based degreasing solution followed by washing with water. The surface was then subjected to pickling by immersion for 5 seconds in a 10% hydrochloric acid pickling solution at 40° C. in which benzylamine was present as an organic inhibitor in different concentrations as indicated in Table 7, followed by washing with rinse water.

Subsequently, one-sided pure Zn electroplating was performed on the steel sheet using a chloride plating solution under the following conditions:
Composition of electroplating solution:
250 g/l of $ZnCl_2$
300 g/l of KCl
pH: 4
Bath temperature: 60° C.
Current density: 60 $A/dm^2$
Coating weight: 20 $g/m^2$.
The resulting one-sided plated sheet was evaluated in the same manner as in Example 3. The results are shown in Table 7.

As can be seen from Table 7, addition of an organic inhibitor to the hydrochloric acid pickling solution of the immersion-type was also effective for prevention of acid burning on the unplated side and a one-sided plated steel sheet of high quality could be obtained.

EXAMPLE 6

Following the procedure described in Example 3, the surface to be plated of a 0.8 mm-thick steel sheet was pretreated by electrolytic degreasing in a sodium hydroxide-based degreasing solution followed by washing with water. The surface was then subjected to electrolytic pickling in a sulfuric acid solution and washed with rinse water in which various organic inhibitors were present as indicated in Table 8.

Subsequently, using an electroplating solution which contained various organic inhibitors as indicated in Table 8, one-sided Zn-Ni alloy electroplating was performed on the steel sheet under the following conditions:
Composition of electroplating solution:
120 g/l of $ZnSO_4.7H_2O$
250 g/l of $NiSO_4.6H_2O$
75 g/l of $Na_2SO_4$
pH: 2
Bath temperature: 55° C.
Current density: 60 $A/dm^2$
Coating weight: 20 $g/m^2$.

The unplated and plated sides of the resulting one-sided electroplated steel sheet were evaluated in the same manner as described in Example 1. The results are shown in Table 8.

As can be seen from Table 8, when both the plating solution and the rinse water used after the pickling solution contained an organic inhibitor, acid burning on the unplated side could be prevented with a lower concentration of the inhibitor on the order of 0.1 ppm or higher.

EXAMPLE 7

A one-sided Zn—Ni alloy electroplated steel sheet was prepared in the same manner as described in Example 1 using a sulfate electroplating solution which contained various organic inhibitors.

The unplated sides of some of the resulting electroplated steel sheets were lightly ground with an abrasive brush sold by Hotani K. K. and having the model number indicated in Table 9 in such a manner that the reduction in PPI (peak count number) was at most 20%.

The unplated and plated sides of the resulting one-sided electroplated steel sheets were evaluated in the same manner as described in Example 1. The results are shown in Table 9 along with the name of the organic inhibitor added to the plating solution and the concentration thereof in the solution. The tests for evaluating the residual Ni amount and the adaptability to phosphating (observation of phosphate crystals) were performed not only in the central portion of the steel sheet but in the edge portions thereof. The value for PPI was measured by a surface roughness tester.

As was found in Example 1, when an organic inhibitor was added to the plating solution in a concentration of at least 1 ppm, the resulting one-sided electroplated steel sheet had good properties in the central portion. In the edge portions, however, bare spots or voids in the phosphated film on the unplated side were observed even in the cases where at least 1 ppm of an inhibitor was added to the plating solution. Such poor results of phosphating in the edge portions could be eliminated by performing light grinding on the unplated surface of the one-sided electroplated steel sheet prior to phosphating.

RUN NO. 5 illustrates the case where the unplated side of the electroplated sheet was ground with a reduction in PPI exceeding 20%. Such severe grinding is not desirable because it causes slip of the sheet in the subsequent working stage.

EXAMPLE 8

A one-sided Zn—Ni alloy electroplated steel sheet was prepared in the same manner as described in Example 2 using a chloride electroplating solution which contained various organic inhibitors. The unplated sides of some of the resulting electroplated steel sheets were lightly ground in the same manner as in Example 7.

The unplated and plated sides of the resulting one-sided electroplated steel sheets were evaluated in the same manner as in Example 7. The test results are shown in Table 10 along with the name and concentration of the organic inhibitor added to the plating solution and the model number of the abrasive brush used in grinding.

Similar results to those in Example 7 were obtained when a chloride electroplating solution was used in this example.

EXAMPLE 9

A one-sided Zn—Ni alloy electroplated steel sheet was prepared in the same manner as described in Example 3 using rinse water containing thiourea. The unplated sides of some of the resulting electroplated steel sheets were lightly ground in the same manner as in Example 7.

The unplated and plated sides of the resulting one-sided electroplated steel sheets were evaluated in the same manner as in Example 7. The test results are shown in Table 11 along with the concentration of thiourea in the rinse water and the model number of the abrasive brush used in grinding.

It can be seen that the properties of the edge portions of the unplated sides of the one-sided electroplated steel sheets were improved by light grinding.

EXAMPLE 10

A one-sided Zn—Ni alloy electroplated steel sheet was prepared in the same manner as described in Example 6. The unplated sides of some of the resulting electroplated steel sheets were lightly ground in the same manner as in Example 7.

The unplated and plated sides of the resulting one-sided electroplated steel sheets were evaluated in the same manner as in Example 7. The test results are shown in Table 12 along with the names and concentrations of the organic inhibitors added to the rinse water and the electroplating solution and the model number of the abrasive brush used in grinding.

As is evident from the results, the properties of the edge portions of the unplated sides of the one-sided electroplated steel sheets were improved by light grinding.

EXAMPLE 11

A one-sided Zn—Ni alloy electroplated steel sheet was prepared in the same manner as described in Example 1 using a sulfate electroplating solution containing thiourea as an organic inhibitor. The concentration of thiourea in the plating solution was controlled to be the predetermined value indicated in Table 13 in the manner described below.

A sample of the electroplating solution was periodically withdrawn from the circulation line for the plating solution and the concentration of thiourea in the sample solution was determined by a sodium azide-iodo-starch color reagent. Thereafter, thiourea was added to the electroplating solution, if necessary, in an amount sufficient to maintain the concentration of thiourea in the solution at the predetermined value.

The quantitative analysis of thiourea was carried out by the following procedure:

(1) A 10 ml sample of the plating solution was diluted to 200 ml with deionized water.

(2) A 20 ml aliquot of the diluted solution was mixed with 10 ml of an aqueous 20% $Fe_2(SO_4)_3.12H_2O$ solution and 50 ml of deionized water.

(3) The pH of the resulting solution was adjusted at pH 10 by addition of sodium hydroxide to precipitate ferric hydroxide [$Fe(OH)_3$].

(4) The resulting slurry was diluted to 100 ml with deionized water.

(5) The diluted slurry was centrifuged for 10 minutes at 3000 rpm to remove metallic ions in the form of hydroxide precipitates along with ferric hydroxide precipitates.

(6) To a 5 ml aliquot of the supernatant, 1 ml of a sodium azide-iodo-starch color reagent was added. The color reagent was prepared by mixing 10 ml of an aqueous 6% $NaN_3$ solution, 10 ml of an aqueous solution containing 200 ppm of $I_2$, 5 ml of an aqueous solution containing 8000 ppm of starch, and 25 ml of a phthalate buffer (pH 4).

(7) After the mixed solution was allowed to stand for 30 minutes, its absorbance at a wavelength of 585 nm was measured and the concentration of thiourea was determined based on the calibration curve shown in FIG. 2.

It was confirmed that the above-mentioned quantitative method can determine the concentration of thiourea in an electroplating solution with an analytical precision of ±0.5 ppm when the concentration was around 3 ppm.

The properties of the unplated side of the resulting one-sided electroplated steel sheet were evaluated in the same manner as described in Example 1. The plated side of the sheet was evaluated with respect to the Ni content of the plated coating and corrosion resistance. The corrosion resistance of the plated side was tested by a salt spray test (SST) performed according to JIS Z 2371 test method. The results were expressed in terms of the time elapsed before red rust was formed on the test piece.

The test results are given in Table 13. The results are similar to those in Example 1. When the concentration of thiourea was excessively high, the Ni content of the plated coating was decreased, leading to a decrease in corrosion resistance. It is estimated that the preferable range of concentration of thiourea when added to a sulfate-type electroplating solution is at least 1 ppm and at most 10 ppm, and more preferably at most 5 ppm.

EXAMPLE 12

A one-sided Zn—Ni alloy electroplated steel sheet was prepared in the same manner as described in Example 3 using rinse water which contained thiourea. The concentration of thiourea in the rinse water was controlled to be the predetermined value indicated in Table 14. The rinse water was circulated while a part of the rinse water was removed. The concentration of thiourea in the circulated rinse water was determined by the procedure described in Example 11 with a sample of the rinse water withdrawn from the circulation line. Thereafter, if necesary, thiourea was added to the rinse water in an amount sufficient to maintain the concentration at the predetermined value.

The properties of the unplated and plated sides of the resulting one-sided electroplated steel sheet were evaluated in the same manner as in Example 11. The test results are shown in Table 14.

The results are similar to those for Example 3. When the concentration of thiourea was excessively high, the corrosion resistance was decreased. Compared to the results for Example 11, the preferable range for the concentration of thiourea is extended to at least 1 ppm and at most 100 ppm when it is added to the rinse water.

EXAMPLE 13

A one-sided Zn—Ni alloy electroplated steel sheet was prepared in the same manner as described in Example 6. The organic inhibitors used in this example were mercaptan, which was added to the rinse water, and thiourea, which was added to the plating solution. The concentrations of the organic inhibitors in the plating solution and the rinse water were controlled to have the predetermined values indicated in Table 15 in the same manner as described in Examples 11 and 12, respectively.

The properties of the unplated and plated sides of the resulting one-sided electroplated steel sheet were evaluated in the same manner as in Example 11. The test results are shown in Table 15.

The results are similar to those for Example 6. When the concentration of mercaptan in the rinse water is 0.2 ppm, the preferable range of the concentration of thiourea in the plating solution is at least 0.1 ppm and at most 5 ppm. On the other hand, when the concentration of mercaptan in the rinse water is 10 ppm, the preferable range of the concentration of thiourea in the plating solution is at least 0.1 ppm and at most 2 ppm.

All the above examples but Example 5 illustrate the preparation of one-sided Zn—Ni alloy electroplated steel sheets. Similar results are obtained by the method of the present invention when it is used for one-sided electroplating with pure Zn or other Zn alloys such as Zn—Fe, Zn—Co, Zn—Ni—Co, and Zn—Mn alloys.

The principles, preferred embodiments and modes of operation of the present invention have been described in the foregoing specification. It should be understood, however, that variations and modifications may be employed without departing from the concept of the invention as defined in the following claims.

TABLE 3

| | | Organic inhibitor | | Properties of unplated side | | | | | | Properties of plated side | |
|---|---|---|---|---|---|---|---|---|---|---|---|
| | | | | | Residual | Adaptability to phosphating | | | | | |
| Run No. | | Compound | Concentration (ppm) | Appearance | Ni ($mg/m^2$) | Film weight ($g/m^2$) | P value | Phosphate crystals | | % Ni | Phase |
| Comparative | 1 | None | | XX | 18.3 | 1.2 | 0.73 | Coarse, Voided | | 12.8 | γ |
| | 2 | Thiourea | 0.1 | X | 9.7 | 3.7 | 0.85 | Coarse | | 12.9 | γ |
| | 3 | " | 0.5 | Δ | 3.1 | 2.9 | 0.82 | Slightly coarse | | 12.8 | γ |
| This Invention | 4 | " | 1 | ○ | 2.1 | 2.1 | 0.95 | Fine | | 12.5 | γ |
| | 5 | " | 5 | ○ | 1.7 | 2.3 | 0.93 | " | | 12.1 | γ |
| | 6 | " | 50 | ○ | 2.0 | 2.5 | 0.90 | " | | 9.1 | η + γ |
| | 7 | " | 5 | ○ | 2.5 | 2.2 | 0.92 | " | | 12.2 | γ |
| | 8 | Formaldehyde | 10 | ○ | 2.3 | 2.7 | 0.95 | " | | 11.9 | γ |
| | 9 | Benzylamine | 5 | ○ | 1.9 | 2.0 | 0.90 | " | | 11.0 | γ |
| | | Thiourea | 5 | | | | | | | | |
| | 10 | Quinoline | 5 | ○ | 1.8 | 2.4 | 0.89 | " | | 11.5 | γ |
| | | Thiourea | 5 | | | | | | | | |

TABLE 4

| Run No. | | Organic inhibitor: Compound | Organic inhibitor: Concentration (ppm) | Properties of unplated side: Appearance | Residual Ni ($mg/m^2$) | Adaptability to phosphating: Film weight ($g/m^2$) | P value | Phosphate crystals | Properties of plated side: % Ni | Phase |
|---|---|---|---|---|---|---|---|---|---|---|
| Compar. | 1 | None | | XX | 14.7 | 1.5 | 0.79 | Voided | 12.4 | γ |
| This | 2 | Benzylamine | 1 | Δ | 8.3 | 2.9 | 0.88 | Coarse | 12.3 | γ |
| Invention | 3 | " | 5 | Δ | 2.7 | 2.1 | 0.92 | Slightly coarse | 12.7 | γ |
| | 4 | " | 10 | ○ | 1.8 | 2.7 | 0.90 | Fine | 11.9 | γ |
| | 5 | " | 100 | ○ | 2.1 | 2.3 | 0.91 | " | 8.7 | η + γ |
| | 6 | Thiourea | 10 | ○ | 1.7 | 2.1 | 0.90 | " | 11.5 | γ |
| | 7 | Quinoline | 10 | ○ | 2.3 | 2.4 | 0.94 | " | 12.1 | γ |
| | 8 | Formaldehyde | 10 | ○ | 1.7 | 2.2 | 0.89 | " | 9.1 | η + γ |
| | 9 | Mercaptan | 10 | ○ | 2.6 | 2.1 | 0.92 | " | 11.5 | γ |
| | 10 | Benzylamine | 5 | ○ | 2.5 | 2.3 | 0.91 | " | 11.3 | γ |
| | | Thiourea | 5 | | | | | | | |

TABLE 5

| Run No. | | Thiourea concentration in rinse water (ppm) | Appearance of unplated side | Residual Ni ($mg/m^2$) | Phosphate film on unplated side: Phosphate crystals* | P value | Weight ($g/m^2$) |
|---|---|---|---|---|---|---|---|
| Compar- | 1 | 0 | XX | 20.3 | XX | 0.36 | 1.2 |
| ative | 2 | 0.1 | X | 16.5 | X | 0.67 | 1.6 |
| This | 3 | 1 | Δ | 13.1 | ○ | 0.93 | 2.1 |
| Invention | 4 | 5 | ○ | 2.7 | ○ | 0.91 | 2.0 |
| | 5 | 10 | ○ | 2.4 | ○ | 0.95 | 2.3 |
| | 6 | 50 | ○ | 2.6 | ○ | 0.92 | 2.2 |
| | 7 | 100 | ○ | 1.8 | ○ | 0.93 | 2.2 |
| | 8 | 1000 | ○ | 1.2 | ○ | 0.92 | 2.1 |

TABLE 6

| Run No. | | Mercaptan concentr. in 5% $H_2SO_4$ solution (ppm) | Appearance of unplated side | Residual Ni ($mg/m^2$) | Phosphate film on unplated side: Phosphate crystals* | P value | Weight ($g/m^2$) |
|---|---|---|---|---|---|---|---|
| Compar- | 1 | 0 | XX | 19.7 | XX | 0.54 | 0.9 |
| ative | 2 | 0.1 | XX | 18.9 | XX | 0.28 | 1.2 |
| | 3 | 0.5 | X | 12.6 | X | 0.65 | 1.5 |
| This | 4 | 1 | ○ | 2.6 | ○ | 0.92 | 2.1 |
| Invention | 5 | 5 | ○ | 1.8 | ○ | 0.96 | 2.2 |
| | 6 | 10 | ○ | 2.2 | ○ | 0.91 | 2.3 |
| | 7 | 100 | ○ | 1.9 | ○ | 0.93 | 2.1 |

*Phosphate crystals - XX: Significantly voided; X: Slightly voided; ○: No void.

TABLE 7

| Run No. | | Benzylamine concentr. in 10% HCl solution (ppm) | Appearance of unplated side | Phosphate film on unplated side: Phosphate crystals* | P value | Weight ($g/m^2$) |
|---|---|---|---|---|---|---|
| Com- | 1 | 0 | XX | XX | 0.25 | 1.0 |
| para- | 2 | 0.1 | XX | XX | 0.38 | 1.3 |
| tive | 3 | 0.5 | X | X | 0.41 | 2.0 |
| This | 4 | 1 | Δ | ○ | 0.87 | 2.1 |
| Inven- | 5 | 5 | ○ | ○ | 0.92 | 2.0 |

TABLE 7-continued

| Run No. | | Benzylamine concentr. in 10% HCl solution (ppm) | Appearance of unplated side | Phosphate film on unplated side: Phosphate crystals* | P value | Weight ($g/m^2$) |
|---|---|---|---|---|---|---|
| tion | 6 | 50 | ○ | ○ | 0.96 | 2.2 |
| | 7 | 100 | ○ | ○ | 0.93 | 2.1 |
| | 8 | 1000 | ○ | ○ | 0.94 | 2.3 |

*Phosphate crystals - XX: Significantly voided; X: Slightly voided; ○: No void.

TABLE 8

| Run No. | | Organic inhibitor in rinse water: Compound | Concen. (ppm) | Organic inhibitor in plating solution: Compound | Concen. (ppm) | Appearance of unplated side | Residual Ni ($mg/m^2$) | Phosphate film on unplated side: Phosphate crystals* | P value | Weight ($g/m^2$) | Electroplated coating: % Ni | Phase |
|---|---|---|---|---|---|---|---|---|---|---|---|---|
| Compar- | 1 | None | | Thiourea | 0.1 | X | 15.7 | X | 0.25 | 1.2 | 12.0 | γ |
| ative | 2 | Thiourea | 0.1 | None | | X | 13.3 | XX | 0.36 | 1.6 | 12.4 | γ |
| This | 3 | " | 0.1 | Thiourea | 0.1 | ○ | 2.0 | ○ | 0.93 | 2.1 | 12.1 | γ |
| Invention | 4 | " | 0.1 | " | 1 | ○ | 1.8 | ○ | 0.89 | 2.2 | 12.2 | γ |
| | 5 | " | 0.5 | " | 0.1 | ○ | 1.9 | ○ | 0.92 | 2.1 | 12.2 | γ |
| | 6 | " | 0.5 | " | 0.5 | ○ | 2.2 | ○ | 0.94 | 2.3 | 12.4 | γ |
| | 7 | " | 1 | " | 1 | ○ | 1.7 | ○ | 0.88 | 2.0 | 12.3 | γ |
| | 8 | Formal- | 0.1 | " | 0.1 | ○ | 2.6 | ○ | 0.91 | 2.0 | 12.2 | γ |

TABLE 8-continued

| Run No. | Organic inhibitor in rinse water: Compound | Concen. (ppm) | Organic inhibitor in plating solution: Compound | Concen. (ppm) | Appearance of unplated side | Residual Ni (mg/m²) | Phosphate film on unplated side: Phosphate crystals* | P value | Weight (g/m²) | Electroplated coating: % Ni | Phase |
|---|---|---|---|---|---|---|---|---|---|---|---|
| | dehyde | | | | | | | | | | |
| 9 | Formal-dehyde | 0.1 | Formal-dehyde | 0.1 | ○ | 2.4 | ○ | 0.90 | 2.0 | 12.1 | γ |

*Phosphate crystals - XX: Significantly voided; X: Slightly voided; ○: No void.

TABLE 9

| No. | Organic inhibitor in plating solution: Compound | Concen-tration (ppm) | Light grinding (abrasive brush) | Properties of unplated side (center portion): Appear-ance | Residual Ni (mg/m²) | Adaptability to phosphating: Film weight (g/m²) | P value | Phosphate Crystals |
|---|---|---|---|---|---|---|---|---|
| 1 | None | | None | XX | 18.3 | 1.2 | 0.75 | Coarse, Voided |
| 2 | Thiourea | 0.1 | " | X | 14.1 | 3.2 | 0.81 | Coarse |
| 3 | " | 1 | " | ○ | 3.7 | 2.1 | 0.95 | Fine |
| 4 | " | 5 | " | ○ | 2.1 | 2.0 | 0.95 | " |
| 5 | " | 50 | 8S-240-3H | ○ | 2.7 | 2.4 | 0.93 | " |
| 6 | " | 0.1 | 3A-1000-7H | X | 8.9 | 3.8 | 0.85 | Coarse |
| 7 | " | 1 | " | ○ | 2.5 | 2.7 | 0.95 | Fine |
| 8 | " | 5 | " | ○ | 1.9 | 1.8 | 0.92 | " |
| 9 | " | 10 | " | ○ | 2.0 | 2.3 | 0.95 | " |
| 10 | Formaldehyde | 10 | " | ○ | 2.7 | 2.5 | 0.91 | " |
| 11 | Benzylamine<br>Thiourea | 5<br>5 | " | ○ | 2.4 | 2.5 | 0.88 | " |
| 12 | Quinoline<br>Thiourea | 5<br>5 | " | ○ | 1.8 | 1.9 | 0.89 | " |

| No. | Properties of unplated side (edge portion): Residual Ni (mg/m²) | Crystals in phosphated film | Properties, plated side: % Ni | Phase | Roughness of unplated side (Reduction in PPI) (%) |
|---|---|---|---|---|---|
| 1 | 24.1 | Coarse, Voided | 12.5 | γ | 0 |
| 2 | 31.4 | Coarse, Voided | 12.7 | γ | 0 |
| 3 | 38.3 | Voided | 12.3 | γ | 0 |
| 4 | 35.2 | " | 11.9 | γ | 0 |
| 5 | 2.1 | Fine | 8.9 | η + γ | 41* |
| 6 | 10.4 | Coarse | 12.4 | γ | 11 |
| 7 | 8.7 | Fine | 12.5 | γ | 7 |
| 8 | 7.4 | " | 12.1 | γ | 2 |
| 9 | 9.1 | " | 11.5 | γ | 5 |
| 10 | 5.2 | " | 12.1 | γ | 17 |
| 11 | 6.3 | " | 11.4 | γ | 9 |
| 12 | 6.5 | " | 11.1 | γ | 4 |

*The great reduction in PPI may cause slip of the sheet at the subsequent working stage.

TABLE 10

| No. | Organic inhibitor in plating solution: Compound | Concen-tration (ppm) | Light grinding (abrasive brush) | Properties of unplated side (center portion): Appear-ance | Residual Ni (mg/m²) | Adaptability to phosphating: Film weight (g/m²) | P value | Phosphate Crystals |
|---|---|---|---|---|---|---|---|---|
| 1 | None | | None | XX | 15.3 | 1.4 | 0.80 | Voided |
| 2 | Benzylamine | 1 | " | Δ | 9.7 | 3.2 | 0.88 | Fine |
| 3 | " | 10 | " | ○ | 2.1 | 2.4 | 0.90 | " |
| 4 | " | 100 | " | ○ | 2.5 | 2.3 | 0.92 | " |
| 5 | " | 0.5 | 3A-500-7H | X | 10.5 | 2.9 | 0.88 | Coarse |
| 6 | " | 1 | " | Δ | 1.8 | 2.5 | 0.91 | Fine |
| 7 | " | 10 | " | ○ | 1.7 | 2.7 | 0.95 | " |
| 8 | Quinoline | 10 | " | ○ | 2.6 | 2.1 | 0.88 | " |
| 9 | Formaldehyde | 10 | " | ○ | 3.2 | 1.8 | 0.94 | " |
| 10 | Mercapto-acetic acid | 10 | " | ○ | 2.5 | 2.0 | 0.89 | " |
| 11 | Benzylamine<br>Thiourea | 5<br>5 | " | ○ | 3.1 | 1.7 | 0.92 | " |
| 12 | Benzylamine<br>Quinoline | 5<br>5 | " | ○ | 2.9 | 1.7 | 0.91 | " |

| No. | Properties of unplated side (edge portion): Residual Ni (mg/m²) | Crystals in phosphated film | Properties, plated side: % Ni | Phase | Roughness of unplated side (Reduction in PPI) (%) |
|---|---|---|---|---|---|

TABLE 10-continued

| | | | | | |
|---|---|---|---|---|---|
| 1 | 18.1 | Coarse, Void | 12.8 | γ | 0 |
| 2 | 25.5 | " | 12.7 | γ | 0 |
| 3 | 35.2 | Voided | 11.8 | γ | 0 |
| 4 | 48.1 | " | 8.8 | η + γ | 0 |
| 5 | 15.7 | Coarse | 12.4 | γ | 10 |
| 6 | 6.8 | Fine | 12.1 | γ | 15 |
| 7 | 9.4 | " | 11.5 | γ | 3 |
| 8 | 5.3 | " | 11.9 | γ | 5 |
| 9 | 7.2 | " | 12.5 | γ | 11 |
| 10 | 6.2 | " | 12.3 | γ | 11 |
| 11 | 6.3 | " | 12.1 | γ | 4 |
| 12 | 6.1 | " | 11.5 | γ | 8 |

TABLE 11

| No. | Thiourea concen. in rinse water (ppm) | Light grinding (abrasive brush) | Properties of unplated side (center portion): Appearance | Residual Ni ($mg/m^2$) | Adaptability to phosphating: Film weight ($g/m^2$) | P value | Phosphate Crystals | Properties of unplated side (edge portion): Residual Ni ($mg/m^2$) | Crystals in phosphated film | Properties, plated side: % Ni | Phase | Roughness of unplated side (Reduction in PPI) (%) |
|---|---|---|---|---|---|---|---|---|---|---|---|---|
| 1 | 0 | None | XX | 22.4 | 1.2 | 0.75 | Coarse, Voided | 24.1 | Coarse, Voided | 12.5 | γ | 0 |
| 2 | 0.1 | " | X | 18.5 | 1.6 | 0.81 | Voided | 25.9 | Coarse, Voided | 12.7 | γ | 0 |
| 3 | 10 | " | ○ | 1.8 | 2.4 | 0.88 | Fine | 28.3 | Voided | 12.3 | γ | 0 |
| 4 | 100 | " | ○ | 2.1 | 2.5 | 0.90 | " | 30.4 | " | 12.0 | γ | 0 |
| 5 | 0.1 | 18S-1000-24H | X | 15.8 | 3.1 | 0.89 | Coarse | 6.3 | Coarse | 12.5 | γ | 9 |
| 6 | 1 | 18S-1000-24H | Δ | 12.1 | 2.4 | 0.91 | Fine | 4.7 | Fine | 12.4 | γ | 13 |
| 7 | 5 | 18S-1000-24H | ○ | 2.5 | 2.1 | 0.93 | " | 5.8 | " | 12.1 | γ | 4 |
| 8 | 10 | 18S-1000-24H | ○ | 2.3 | 2.3 | 0.92 | " | 5.9 | " | 12.3 | γ | 4 |
| 9 | 50 | 18S-1000-24H | ○ | 1.7 | 2.1 | 0.92 | " | 6.0 | " | 12.4 | γ | 5 |
| 10 | 100 | 18S-1000-24H | ○ | 1.9 | 2.0 | 0.94 | " | 7.2 | " | 11.8 | γ | 8 |

TABLE 12

| No. | Organic inhibitor in rinse water: Compound | Conc. (ppm) | Organic inhibitor in plating solution: Compound | Conc. (ppm) | Light grinding (abrasive brush) | Properties of unplated side (center portion): Appearance | Residual Ni ($mg/m^2$) | Adaptability to phosphating: Film weight ($g/m^2$) | P value | Phosphate Crystals |
|---|---|---|---|---|---|---|---|---|---|---|
| 1 | None | | Thiourea | 0.1 | None | X | 15.3 | 3.8 | 0.70 | Coarse |
| 2 | Thiourea | 0.1 | None | | " | X | 11.2 | 3.5 | 0.85 | " |
| 3 | " | 0.5 | Thiourea | 0.5 | " | ○ | 3.2 | 2.2 | 0.92 | Fine |
| 4 | " | 0.1 | None | | 3A-1000-7H | X | 13.4 | 2.8 | 0.88 | Coarse |
| 5 | " | 0.1 | Thiourea | 1 | 3A-1000-7H | ○ | 3.4 | 2.3 | 0.90 | Fine |
| 6 | " | 0.5 | " | 0.5 | 3A-1000-7H | ○ | 4.1 | 2.1 | 0.91 | " |
| 7 | " | 1 | " | 1 | 3A-1000-7H | ○ | 3.8 | 2.2 | 0.90 | " |
| 8 | Formaldehyde | 0.1 | " | 0.1 | 3A-1000-7H | ○ | 2.4 | 1.8 | 0.94 | " |
| 9 | Formaldehyde | 0.1 | Formaldehyde | 0.1 | 3A-1000-7H | ○ | 3.2 | 2.1 | 0.92 | " |
| 10 | Thiourea | 0.1 | Formaldehyde | 0.1 | 3A-1000-7H | ○ | 2.1 | 1.9 | 0.95 | " |

| No. | Properties of unplated side (edge portion): Residual Ni ($mg/m^2$) | Crystals in phosphated film | Properties, plated side: % Ni | Phase | Roughness of unplated side (Reduction in PPI) (%) |
|---|---|---|---|---|---|
| 1 | 23.8 | Coarse, Voided | 12.0 | γ | 0 |
| 2 | 30.5 | Coarse, Voided | 11.9 | γ | 0 |
| 3 | 38.4 | Voided | 11.3 | γ | 0 |
| 4 | 8.5 | Fine | 11.8 | γ | 16 |
| 5 | 6.6 | " | 11.4 | γ | 8 |
| 6 | 5.4 | " | 11.5 | γ | 3 |
| 7 | 5.7 | " | 11.3 | γ | 9 |
| 8 | 7.1 | " | 12.1 | γ | 4 |

TABLE 12-continued

| | | | | | |
|---|---|---|---|---|---|
| 9 | 4.8 | " | 12.0 | γ | 4 |
| 10 | 5.5 | " | 11.6 | γ | 12 |

TABLE 13

| No. | Thiourea concentration in plating solution (ppm) | Properties of unplated side: Appearance | Residual Ni ($mg/m^2$) | Adaptability to phosphating: Film weight ($g/m^2$) | P value | Phosphate crystals | Properties of plated side: % Ni | Corrosion resistance in SST (hr) |
|---|---|---|---|---|---|---|---|---|
| 1 | 0 | XX | 18.3 | 1.2 | 0.75 | Coarse, Voided | 12.5 | 360 |
| 2 | 0.1 | X | 14.1 | 3.2 | 0.81 | Coarse | 12.7 | 384 |
| 3 | 1.2 | ○ | 3.7 | 2.1 | 0.95 | Fine | 12.3 | 360 |
| 4 | 4.7 | ○ | 2.1 | 2.0 | 0.95 | " | 11.9 | 336 |
| 5 | 9.5 | ○ | 2.0 | 2.3 | 0.95 | " | 11.5 | 288 |
| 6 | 44 | ○ | 2.7 | 2.4 | 0.93 | " | 8.9 | 216 |
| 7 | 102 | ○ | 2.2 | 2.2 | 0.91 | " | 8.1 | 144 |

TABLE 14

| No. | Thiourea concentration in rinse water (ppm) | Properties of unplated side: Appearance | Residual Ni ($mg/m^2$) | Adaptability to phosphating: Film weight ($g/m^2$) | P value | Phosphate crystals | Properties of plated side: % Ni | Corrosion resistance in SST (hr) |
|---|---|---|---|---|---|---|---|---|
| 1 | 0 | XX | 22.4 | 1.2 | 0.75 | Coarse, Voided | 12.5 | 360 |
| 2 | 0.3 | X | 18.5 | 1.6 | 0.81 | Voided | 12.7 | 360 |
| 3 | 1.3 | Δ | 12.1 | 2.4 | 0.91 | Fine | 12.4 | 360 |
| 4 | 9.8 | ○ | 2.3 | 2.3 | 0.92 | " | 12.3 | 360 |
| 5 | 44 | ○ | 1.7 | 2.1 | 0.92 | " | 12.4 | 336 |
| 6 | 95 | ○ | 1.9 | 2.0 | 0.94 | " | 11.8 | 288 |
| 7 | 1031 | ○ | 2.1 | 2.0 | 0.93 | " | 9.0 | 192 |

TABLE 15

| No.* | Mercaptan concentration in rinse water (ppm) | Thiourea concentration in plating solution (ppm) | Properties of unplated side: Appearance | Residual Ni ($mg/m^2$) | Adaptability to phosphating: Film weight ($g/m^2$) | P value | Phosphate crystals | Properties of plated side: % Ni | Corrosion resistance in SST (hr) |
|---|---|---|---|---|---|---|---|---|---|
| 1 | 0.2 | 0 | X | 15.8 | 1.7 | 0.80 | Voided | 12.7 | 384 |
| 2 | " | 0.3 | ○ | 2.4 | 1.8 | 0.94 | Fine | 12.1 | 336 |
| 3 | " | 4.4 | ○ | 2.7 | 2.5 | 0.94 | " | 11.8 | 288 |
| 4 | " | 10.2 | ○ | 2.8 | 2.3 | 0.95 | " | 9.5 | 192 |
| 5 | 9.8 | 0.2 | ○ | 3.8 | 2.8 | 0.91 | " | 12.3 | 360 |
| 6 | " | 1.8 | ○ | 3.5 | 2.4 | 0.94 | " | 12.0 | 312 |
| 7 | " | 6.7 | ○ | 2.1 | 2.1 | 0.96 | " | 9.0 | 216 |

What is claimed is:

1. A method for manufacturing a one-sided electroplated steel sheet having a plated side and an unplated side, the steel sheet having improved appearance and adaptability to phosphating on the unplated side by electroplating the steel sheet in an acidic bath containing an electroplating solution, the method including adding an adsorption film-forming organic inhibitor to a solution selected from the group consisting of:

(a) the electroplating solution in a concentration of at least 1 ppm, (b) at least one of a pickling solution used prior to electroplating and rinse water used for rinsing the pickled sheet in a concentration of at least 1 ppm, and (c) both the electroplating solution and at least one of the pickling solution and rinse water in a concentration of at least 0.1 ppm, and passing the steel sheet through the inhibitor-containing solution.

2. The method according to claim 1, wherein the electroplating solution is a sulfate solution and the organic inhibitor is added to the electroplating solution in a concentration of 1–10 ppm.

3. The method according to claim 1, wherein the electroplating solution is a chloride solution and the organic inhibitor is added to the electroplating solution in a concentration of 7–50 ppm.

4. The method according to claim 1, wherein the steel sheet passes through the pickling solution and the rinse water prior to passing through the electroplating solution, the organic inhibitor being added to at least one of the pickling solution and the rinse water in a concentration of 5–100 ppm.

5. The method according to claim 1, wherein the steel sheet passes through the pickling solution and the rinse water prior to passing through the electroplating solution, the organic inhibitor being added both to the electroplating solution and to at least one of the pickling solution and the rinse water in a concentration of 0.1–5 ppm each.

6. The method according to claim 5, wherein the electroplating solution is a sulfate solution and the organic inhibitor is added to the electroplating solution in a concentration of 0.1–1 ppm.

7. The method according to claim 1, further comprising a step of subjecting the unplated side of the resulting one-sided electroplated steel sheet to light grinding.

8. The method according to claim 1, further comprising a step of maintaining the concentration of the organic inhibitor in the solution to which it is added in a predetermined range by determining the concentration of the solution in a circulation line through which it is circulated and adding the inhibitor to the solution in an amount sufficient to maintain the concentration in the predetermined range.

9. The method according to claim 8, wherein the organic inhibitor is an organic compound which contains a sulfur atom having a lone pair of electrons and wherein the determination of the concentration of the organic inhibitor is performed by absorption spectrophotometry using a sodium azide-iodo-starch color reagent.

10. The method according to claim 9, wherein prior to the addition of the color reagent, the organic inhibitor-containing solution to be tested is freed of metallic ions by adding to the solution an aqueous solution which contains ferric ions followed by an alkali, thereby causing the metallic ions to precipitate as hydroxides along with precipitation of ferric hydroxide, and then removing the precipitates from the solution.

11. The method according to claim 10, wherein the color reagent contains a phthalate buffer.

12. The method according to claim 1, wherein the electroplating solution includes an amount of zinc effective to provide a zinc coating on the steel sheet.

13. The method according to claim 1, wherein the electroplating solution includes an amount of zinc-based alloy effective to provide a zinc-based alloy coating on the steel sheet.

14. The method according to claim 1, wherein the electroplating solution includes an amount of zinc-based alloy containing at least one element from the group consisting of Ni, Fe, Co and Mn effective to provide a zinc-based alloy coating containing at least one element from the group consisting of Ni, Fe, Co and Mn on the steel sheet.

15. The method according to claim 7, wherein the light grinding is performed with a brush.

16. The method according to claim 7, wherein the light grinding reduces peak count number (PPI) no more than 20%, PPI being equal to number per inch of raised portions on the unplated side of the steel sheet having a peak height of at least 0.8 $\mu$m.

17. The method according to claim 1, wherein the inhibitor comprises a sulfur-containing inhibitor selected from the group consisting of mercaptans, thiocyanates, sulfides, disulfides, thiocarbonyl-containing compounds, thiocarbonyl compounds, thioureas, dithiocarbamates and thiazoles.

18. The method according to claim 1, wherein the inhibitor comprises a nitrogen-containing inhibitor selected from the group consisting of primary amines, secondary amines, tertiary amines, diamines, amides, hydrazines, aromatic amines, heterocyclic amines, imidazoles and triazoles.

19. The method according to claim 1, wherein the inhibitor comprises an oxygen-containing inhibitor selected from the group consisting of aldehydes, ketones and alkynes.

20. The method according to claim 1, wherein the inhibitor comprises a polar organic compound selected from the group consisting of sulfur-containing organic compounds, nitrogen-containing organic compounds and oxygen-containing organic compounds.

* * * * *